US011097915B2

(12) United States Patent
Nakajima

(10) Patent No.: US 11,097,915 B2
(45) Date of Patent: Aug. 24, 2021

(54) IMAGE FORMING APPARATUS

(71) Applicant: CANON KABUSHIKI KAISHA, Tokyo (JP)

(72) Inventor: Keita Nakajima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 15/952,670

(22) Filed: Apr. 13, 2018

(65) Prior Publication Data

US 2018/0305154 A1 Oct. 25, 2018

(30) Foreign Application Priority Data

Apr. 21, 2017 (JP) ..... JP2017-084430

(51) Int. Cl.
*B65H 7/02* (2006.01)
*B65H 7/12* (2006.01)
*B65H 5/06* (2006.01)

(52) U.S. Cl.
CPC ..... *B65H 7/12* (2013.01); *B65H 5/062* (2013.01); *B65H 7/02* (2013.01); *B65H 2511/11* (2013.01); *B65H 2511/51* (2013.01); *B65H 2511/515* (2013.01); *B65H 2511/528* (2013.01); *B65H 2513/50* (2013.01); *B65H 2513/512* (2013.01); *B65H 2513/514* (2013.01); *B65H 2601/11* (2013.01)

(58) Field of Classification Search
CPC ..... B65H 7/12; B65H 7/02; B65H 2511/11; B65H 2511/51; B65H 2511/515; B65H 7/06
See application file for complete search history.

(56) References Cited

U.S. PATENT DOCUMENTS 5,875,033 A 2/1999 Kawata et al.
7,111,841 B2 9/2006 Jacobs et al.
8,019,236 B2 9/2011 Abe
(Continued)

FOREIGN PATENT DOCUMENTS

CN 1637634 A 7/2005
CN 101169605 A 4/2008
(Continued)

OTHER PUBLICATIONS

Machine translation of JP2006-176245. (Year: 2006).*
Office Action dated Nov. 23, 2020, in Chinese Patent Application No. 201810340347.9.

*Primary Examiner* — Thomas A Morrison
(74) *Attorney, Agent, or Firm* — Venable LLP

(57) ABSTRACT

An image forming apparatus includes a first detection unit, a second detection unit, a first conveyance unit, a second conveyance unit, which is provided on downstream in the conveyance direction with respect to the first detection unit and is configured to convey sheets, and a control unit. When the first detection unit does not detect a trailing edge of a first sheet before a first timing, the control unit stops the drive of the first conveyance unit and continues drive of the second conveyance unit, and when the second detection unit detects the trailing edge of the first sheet before a second timing later than the first timing, the control unit re-drives the first conveyance unit or stops the drive of the second conveyance unit in accordance with a sheet length of the first sheet in the conveyance direction.

16 Claims, 7 Drawing Sheets

(56) References Cited

U.S. PATENT DOCUMENTS

| | | | | |
|---|---|---|---|---|
| 8,033,545 | B2 * | 10/2011 | Prinz | B65H 29/62 271/165 |
| 8,340,563 | B2 | 12/2012 | Nakajima et al. | |
| 9,588,474 | B2 | 3/2017 | Tomoe et al. | |
| 9,682,836 | B2 | 6/2017 | Kowase | |
| 2016/0289027 | A1 * | 10/2016 | Mizuno | B65H 7/14 |
| 2016/0370748 | A1 | 12/2016 | Tani | |
| 2018/0099827 | A1 * | 4/2018 | Tsuboi | B65H 5/38 |

FOREIGN PATENT DOCUMENTS

| | | | |
|---|---|---|---|
| CN | 106019883 | A | 10/2016 |
| CN | 106081708 | A | 11/2016 |
| JP | 08-099770 | A | 4/1996 |
| JP | 09-100048 | A | 4/1997 |
| JP | 10-194529 | A | 7/1998 |
| JP | 2005-179060 | A | 7/2005 |
| JP | 2006-171142 | A | 6/2006 |
| JP | 2006-176245 | A | 7/2006 |
| JP | 2011-213446 | A | 10/2011 |
| JP | 2013-095544 | A | 5/2013 |
| JP | 2017-007863 | A | 1/2017 |

* cited by examiner

| OPERATIONS FOR TRAILING EDGE POSITION OF PRECEDING SHEET S1 | | | | |
|---|---|---|---|---|
| | L1 | L2 | L3 | L4 |
| L6 | NORMAL PRINT ACTION | NORMAL PRINT ACTION | SHEET LENGTH IRREGULARITY | JAM |
| L5 | JAM | JAM | JAM | JAM |

| OPERATIONS FOR TRAILING EDGE POSITION OF PRECEDING SHEET S1 | | | | |
|---|---|---|---|---|
| | L1 | L2 | L3 | L4 |
| L6 | NORMAL PRINT ACTION | NORMAL PRINT ACTION | - | - |
| L5 | JAM | JAM | JAM | - |

IMAGE FORMING APPARATUS

BACKGROUND OF THE INVENTION

Field of the Invention

The present invention relates to an image forming apparatus configured to form an image by an electrophotographic process, and more particularly, to an image forming apparatus configured to perform jam handling of a sheet.

DESCRIPTION OF THE RELATED ART

With a related-art image forming apparatus, before giving a print instruction, a user can input a sheet length (length of a sheet in a conveyance direction) of a sheet to be printed through an operation unit of the image forming apparatus. Further, in another image forming apparatus, there is provided a trailing edge regulation member configured to regulate a trailing edge (edge on an upstream side in a sheet feeding direction) of a sheet stacked on a sheet feeding tray. The trailing edge regulation member can be moved in accordance with the sheet stacked on the sheet feeding tray, and the image forming apparatus can detect a sheet length of the sheet stacked on the sheet feeding tray in accordance with a position of the trailing edge regulation member. When a user inputs a sheet length which is different from that of a sheet actually stacked on the sheet feeding tray, or when a user does not move a position of the trailing edge regulation member in accordance with the sheet actually stacked on the sheet feeding tray, an incorrect sheet length is set to the image forming apparatus.

In an image forming apparatus described in Japanese Patent Application Laid-Open No. H10-194529, after a sheet is fed from a sheet feeding tray, an actual sheet length of the sheet being conveyed is detected by a sensor provided on a conveyance path. Then, the actual sheet length detected by the sensor and a preset sheet length are compared. When a difference in sheet length is beyond a predetermined range (sheet length irregularity margin), the image forming apparatus determines that sheet length irregularity is present. When the image forming apparatus determines that the sheet length irregularity is present, the image forming apparatus stops the print action and allows the sheet being conveyed to be discharged to an outside of the image forming apparatus. Then, the image forming apparatus displays information of the sheet length irregularity on a display screen of the operation unit to notify a user of the presence of the sheet length irregularity.

In recent years, for improvement in productivity of an image forming apparatus, there has been a strong demand for shortening a distance between a trailing edge of a preceding sheet and a leading edge of a following sheet (hereinafter also referred to as "distance between sheets", "sheet-to-sheet distance", or "sheet interval") during conveyance as much as possible.

FIG. 7A is a schematic view for illustrating a positional relationship between a preceding sheet S1 fed ahead and a following sheet S2 fed subsequently to the sheet S1 under a state in which a distance between sheets being continuously fed is long. A region L1 is a preset sheet length of the preceding sheet S1. A region L2 is a margin region of the sheet length of the preceding sheet S1. A region L3 is a region which leads to determination that the sheet length irregularity of the preceding sheet S1 is present. A region L4 is a region which leads to determination that a jam of the preceding sheet S1 has occurred.

A top sensor 100 includes a lever as illustrated in FIG. 7A, and a shortest sheet-to-sheet distance which can be detected is given in advance. With a position of the leading edge of the following sheet S2 as a reference, when the trailing edge of the preceding sheet S1 is positioned in a region L5, the top sensor 100 cannot detect the trailing edge of the preceding sheet S1 and the leading edge of the following sheet S2. Therefore, it is determined that a jam has occurred. When the trailing edge of the preceding sheet S1 is positioned in the region L3, it is not determined that the jam has occurred, and is determined that the sheet length irregularity is present. Therefore, the preceding sheet S1 is conveyed as it is together with the following sheet S2, and is discharged to an outside of the image forming apparatus. A region L6, a region L7, and a region L8 are described later in detail.

FIG. 7B is a schematic view for illustrating a positional relationship between the preceding sheet S1 fed ahead and the following sheet S2 fed subsequently to the preceding sheet S1 under a state in which a distance between the sheets being continuously fed is short. In the case of FIG. 7B, the region L3 which leads to the determination that the sheet length irregularity of the preceding sheet S1 is present is positioned in the region L5 in which the top sensor 100 cannot detect the trailing edge of the preceding sheet S1 and the leading edge of the following sheet S2. Thus, when the trailing edge of the preceding sheet S1 is positioned in the region L3, it is determined that a jam has occurred. Therefore, conveyance of the preceding sheet S1 and the following sheet S2 is stopped, and the preceding sheet S1 and the following sheet S2 stay in the image forming apparatus. As a result, it is required that a user remove the preceding sheet S1 and the following sheet S2 which stay in the image forming apparatus.

As described above, when the actual sheet length of the preceding sheet S1 is larger than the preset sheet length, and the trailing edge is positioned in the region L3 being a sheet length irregularity region, control to be performed later differs depending on the sheet-to-sheet distance. That is, under a state in which the sheet-to-sheet distance is long, it is determined that the sheet length irregularity is present, and hence the preceding sheet S1 is automatically discharged to the outside of the image forming apparatus. Meanwhile, even when the sheet lengths are equal, under the state in which the sheet-to-sheet distance is small, it is determined that the jam (paper jam) has occurred, with the result that jam handling by a user is required.

SUMMARY OF THE INVENTION

According to one aspect of the present invention, there is provided an image forming apparatus, in which regardless of the magnitude of a sheet interval, when an actual sheet length is longer than a set sheet length, a sheet being conveyed is discharged to an outside of the image forming apparatus without handling by a user.

According to another aspect of the present invention, there is provided an image forming apparatus including a first detection unit provided on a conveyance path for introducing a sheet from a stacking unit on which the sheet is stacked to an image forming portion for performing image formation on the sheet, and is configured to detect the sheet, a second detection unit provided downstream in a conveyance direction of the sheet with respect to the first detection unit, and is configured to detect the sheet, a first conveyance unit provided upstream in the conveyance direction with respect to the first detection unit, and is configured to convey the sheet, a second conveyance unit provided downstream in the conveyance direction with respect to the first detection unit, and is configured to convey the sheet, and a control unit configured to start drive of the first conveyance unit and the second conveyance unit in a case where a first sheet and a second sheet subsequent to the first sheet are fed from the stacking unit, the control unit being configured to stop the drive of the first conveyance unit and continue drive of the second conveyance unit in a case where the first detection unit does not detect a trailing edge of the first sheet before a first timing, and the control unit being configured to re-drive the first conveyance unit or stop the drive of the second conveyance unit in accordance with a sheet length of the first sheet in the conveyance direction in a case where the second detection unit detects the trailing edge of the first sheet before a second timing later than the first timing.

Further features of the present invention will become apparent from the following description of exemplary embodiments with reference to the attached drawings.

DESCRIPTION OF THE EMBODIMENTS

Now, embodiments of the present invention are described in detail with reference to the drawings.

[Detection of Sheet Length when Sheet-to-Sheet Distance is Long]

Figure 7A:
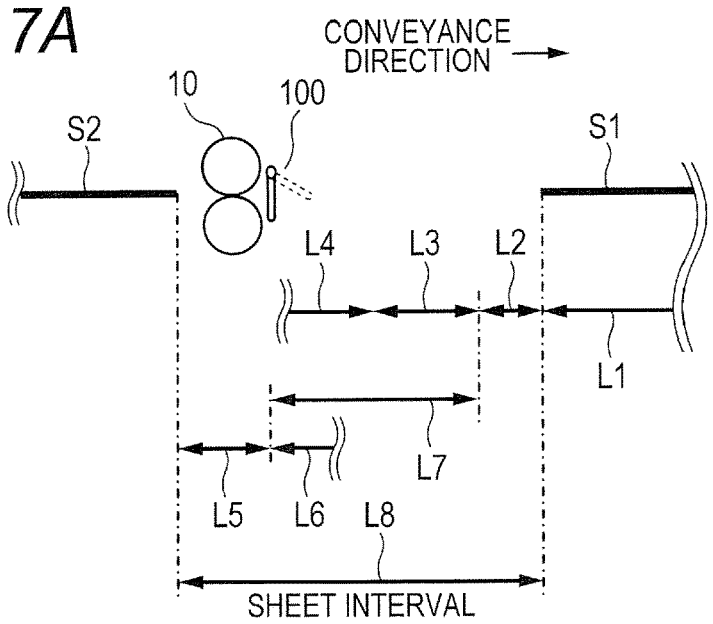
FIG. 7A and FIG. 7B are schematic views for illustrating regions related to the sheet length irregularity and the like in a related-art example.
Figure 7B:
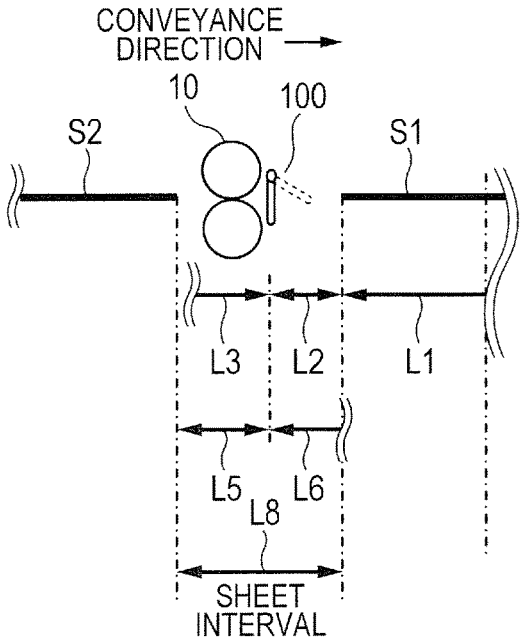

First, for comparison with the embodiments described later, description is made of a detection method for a sheet length, which is performed by a conveyance sensor configured to detect a sheet being conveyed, with reference to the drawings. FIG. 7A and FIG. 7B are schematic views for illustrating the detection method for a sheet length in a conveyance direction of a sheet being conveyed, which is performed by the conveyance sensor provided on a conveyance path, and for illustrating detection of irregularity with respect to a preset sheet length and detection of a jam of a sheet (paper jam) in accordance with a detection state of the sheet length. The preset sheet length is a sheet length (length of a sheet in the conveyance direction) of a sheet set by a user through an operation unit, or a sheet length of a stacked sheet determined in accordance with a position at which the trailing edge regulation member of the sheet feeding tray is set as mentioned above.

FIG. 7A is a schematic view for illustrating related-art conveyance control under a state in which a distance between sheets being continuously fed is long. FIG. 7A is an illustration of a positional relationship of two sheets being continuously fed, a registration roller pair 10, and a top sensor 100 being a conveyance sensor. The two sheets being continuously fed include a preceding sheet S1 (first sheet) fed ahead and a following sheet S2 (second sheet) fed subsequently to the preceding sheet S1. The registration roller pair 10 is described later. The top sensor 100 being a first detection unit includes a lever as illustrated in FIG. 7A. The lever of the top sensor 100 is shifted from the state indicated by the solid line, in which the preceding sheet S1 is not passing, to the state indicated by the broken line, in which the lever is pushed by the preceding sheet S1 being conveyed. With this action, arrival of the leading edge of the preceding sheet S1 is detected. Further, the top sensor 100 is shifted from the state indicated by the broken line to the state indicated by the solid line. With this action, the fact that the trailing edge of the preceding sheet S1 has passed is detected. The actual sheet length of the preceding sheet S1 in the conveyance direction can be calculated based on elapsed time from detection of the leading edge of the sheet S1 to detection of the trailing edge of the sheet S1 by the top sensor 100 provided in the vicinity of downstream of the registration roller pair 10 and the conveyance speed of the sheet S1. As described above, the image forming apparatus calculates the sheet length of the preceding sheet S1 based on detection results of the leading edge and the trailing edge of the preceding sheet S1 by the top sensor 100.

In FIG. 7A, the preceding sheet S1 is depicted with a sheet length (region L1) which is preset to the image forming apparatus. The region L2 is a margin region which does not lead to determination that the sheet length irregularity is present as a result of comparison between the actual sheet length of the preceding sheet S1 and the preset sheet length. Thus, when there are given a sheet length L(S1) of the preceding sheet S1, a length L(L1) of the region L1, and a length L(L1+L2) of the region (L1+L2), the sheet length L(S1) which does not lead to the determination that the sheet length irregularity is present is expressed by L(S1)≤L(L1+L2). As a result of detection of the actual sheet length, when the sheet trailing edge of the preceding sheet S1 is positioned in the region L2 being a sheet length irregularity margin region, the image forming apparatus performs a normal print action with respect to the preceding sheet S1.

The region L3 is a region which leads to determination that the irregularity is present between the actual sheet length calculated by detection of the trailing edge of the preceding sheet S1 and the preset sheet length. When a length of the region (L1+L2+L3) is expressed by L(L1+L2+L3), the sheet length L(S1) of the preceding sheet S1 which leads to the determination that the sheet length irregularity is present is expressed by the size relationship of L(L1+L2) <L(S1)≤L(L1+L2+L3). As a result of detection of the actual sheet length, when the sheet trailing edge of the preceding sheet S1 is positioned in the region L3 being the sheet length irregularity region, the image forming apparatus stops the print action, and all the sheets being conveyed in the image forming apparatus are discharged to the outside of the image forming apparatus.

The region L4 is a region which leads to determination that a stay jam of the preceding sheet S1 has occurred based on the actual sheet length calculated through detection of the trailing edge of the preceding sheet S1. The sheet length L(S1) of the preceding sheet S1 which leads to the determination that the stay jam has occurred is expressed by the size relationship of L(L1+L2+L3)<L(S1). As a result of detection of the actual sheet length, when the sheet trailing edge of the preceding sheet S1 is positioned in the stay jam region L4, the image forming apparatus determines that the preceding sheet S1 stays at the top sensor 100, and stops the print action.

The regions L1 to L4 described above are regions given when the leading edge and the trailing edge of the preceding sheet S1 are detected by the top sensor 100 and the actual sheet length is calculated, and include regions which do not lead to the determination that the sheet length irregularity is present, a region which leads to the determination that the sheet length irregularity is present, and a region which leads to the determination that the stay jam has occurred. Meanwhile, the region L8 illustrated in FIG. 7A is a sheet-to-sheet distance between the preceding sheet S1 and the following sheet S2. Further, the regions L5, L6, and L7 correspond to a region in which a sheet interval between sheets being continuously conveyed cannot be detected, a region in which the sheet interval between sheets being continuously conveyed can be detected, and a region in which the sheet length irregularity of the preceding sheet S1 can be detected, respectively.

The top sensor 100 detects passage of the leading edge of the preceding sheet S1 when the lever is shifted from the state illustrated with the solid lines to the state illustrated with the broken lines as illustrated in FIG. 7A. The top sensor 100 detects passage of the trailing edge of the preceding sheet S1 when the lever is shifted from the state illustrated with the broken lines to the state illustrated with the solid lines. Therefore, when the trailing edge of the preceding sheet S1 is positioned within the region L5, the following sheet S2 arrives at the top sensor 100 after the trailing edge of the preceding sheet S1 passes through the lever of the top sensor 100 and before the lever returns to the state illustrated with the solid lines. As a result, the lever is not shifted to the state illustrated with the solid lines. Thus, the top sensor 100 cannot detect the passage of the trailing edge of the preceding sheet S1 and the leading edge of the following sheet S2. That is, the top sensor 100 cannot detect an interval between the preceding sheet S1 and the following sheet S2 being continuously conveyed (hereinafter also referred to as "sheet-to-sheet distance" or "sheet interval"). As described above, when the sheet-to-sheet distance is excessively small (less than predetermined sheet interval) so that the trailing edge of the preceding sheet S1 is positioned within the region L5, the top sensor 100 cannot detect a sheet interval between two sheets. Therefore, the region L5 is a region which leads to the determination that a jam of the preceding sheet S1 or the following sheet S2 has occurred.

Meanwhile, the region L6 is a region in which the interval between sheets being continuously conveyed can be detected. When the sheet trailing edge of the preceding sheet S1 is positioned within the region L6, the top sensor 100 can detect the trailing edge of the preceding sheet S1 and the leading edge of the following sheet S2. Therefore, the image forming apparatus calculates the sheet length of the preceding sheet S1 based on the timing of passage of the leading edge and the trailing edge of the preceding sheet S1, which is detected by the top sensor 100, and performs the above-mentioned operation in accordance with the calculated sheet length. Further, the region L7 is a region in which the sheet length irregularity of the preceding sheet S1 with respect to the preset sheet length can be detected. As illustrated in FIG. 7A, when the start position of the region L3 involving the sheet length irregularity, which corresponds to the start position of the region L7, is located downstream in the conveyance direction with respect to the start position of the region L6, which corresponds to the end position of the region L7 and in which the sheet interval can be detected, the sheet length irregularity of the preceding sheet S1 can be detected. The start position of the region L4 which leads to the determination that the stay jam has occurred is positioned within the region L6, within the region L5, or any position which differs depending on the control specification for conveyance of the sheet in the image forming apparatus.

The table shown in FIG. 7A is a table for showing correspondence between positions of the trailing edge of the preceding sheet S1, which are illustrated in the schematic view of FIG. 7A, and operations of the image forming apparatus. In a case in which the trailing edge of the preceding sheet S1 is positioned in the region L6, when the trailing edge of the preceding sheet S1 is positioned in the region L1 or L2, the image forming apparatus performs the normal print action. When the trailing edge of the preceding sheet S1 is positioned in the region L3, the image forming apparatus determines that irregularity is present between the sheet length of the preceding sheet S1 and the set sheet length. Further, when the trailing edge of the preceding sheet S1 is positioned in the region L4, the image forming apparatus determines that a jam of the preceding sheet S1 has occurred. Meanwhile, in a case in which the trailing edge of the preceding sheet S1 is positioned in the region L5, even when the trailing edge of the preceding sheet S1 is positioned in any of the regions L1 to L4, the image forming apparatus determines that the jam of the preceding sheet S1 has occurred.

[Detection of Sheet Length when Sheet-to-Sheet Distance is Short]

FIG. 7B is a schematic view for illustrating a positional relationship of the preceding sheet S1, the following sheet S2, the registration roller pair 10, and the top sensor 100 in the related-art conveyance control in a case in which the distance between sheets being continuously conveyed (L8) is small. In FIG. 7B, in order to shorten the sheet-to-sheet distance, the regions L1 and L2 which are associated with a normal print action are positioned in the region L6 in which the interval between sheets being continuously conveyed can be detected. Therefore, when the actual sheet length of the preceding sheet S1 is larger than the preset sheet length, and the trailing edge of the preceding sheet S1 is positioned in the sheet length irregularity region L3 or L4, it is positioned in the region L5 in which the trailing edge of the preceding sheet S1 and the leading edge of the following sheet S2 cannot be detected.

Further, the table shown in FIG. 7B is a table for showing correspondence between positions of the trailing edge of the preceding sheet S1, which are illustrated in the schematic view of FIG. 7B, and operations of the image forming apparatus. In a case in which the trailing edge of the preceding sheet S1 is positioned in the region L6, when the trailing edge of the preceding sheet S1 is positioned in the region L1 or L2, the image forming apparatus performs the normal print action. Meanwhile, when the trailing edge of the preceding sheet S1 is positioned in the region L5, the top sensor 100 cannot detect the sheet interval between the preceding sheet S1 and the following sheet S2. As a result, even when the trailing edge of the preceding sheet S1 is present in any of the regions L1 to L3, the image forming apparatus determines that the jam has occurred due to the fact that the preceding sheet S1 stays at the top sensor 100 or due to the fact that the leading edge of the following sheet S2 cannot be detected.

As described above, in the case in which the actual sheet length of the preceding sheet S1 is larger than the preset sheet length, and the trailing edge is positioned within the sheet length irregularity region L3, when the sheet-to-sheet distance is long, it is determined that the sheet length irregularity is present, and the preceding sheet S1 is discharged to an outside of the image forming apparatus. Meanwhile, even in the case in which the sheet lengths are equal, when the sheet-to-sheet distance (L8) is short, it is determined that the jam has occurred, with the result that jam handling by a user is required.

First Embodiment

[Configuration of Image Forming Apparatus]

Figure 1:
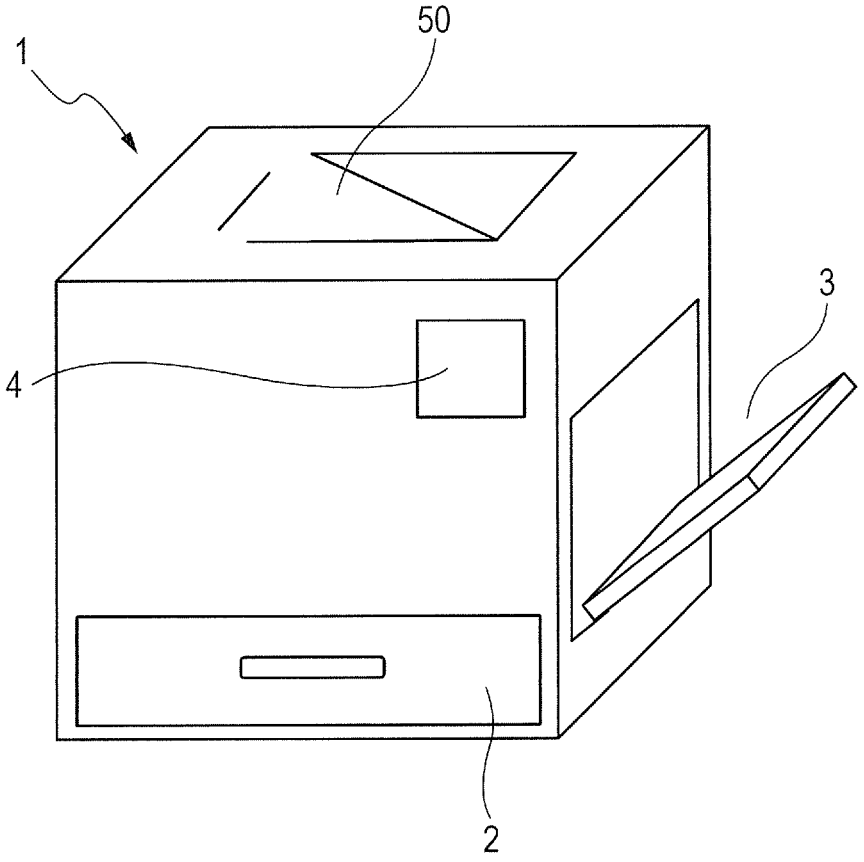
FIG. 1 is a perspective view for illustrating an outer appearance of an image forming apparatus according to a first embodiment and a second embodiment of the present invention.

FIG. 1 is a schematic view for illustrating an outer appearance of an image forming apparatus 1 according to a first embodiment of the present invention. The image forming apparatus 1 includes a sheet feeding cassette 2 which has a sheet feeding tray (stacking unit) on which a sheet to be printed is stacked, and a manual feeding tray 3 (stacking unit) on which a sheet is directly stacked. The sheet feeding cassette 2 has a configuration in which the sheet feeding tray is drawn out as the sheet feeding cassette 2 is drawn out in a direction toward a near side in FIG. 1. A sheet having been printed and a sheet to be discharged due to the jam are discharged onto a discharge tray 50 provided in an upper portion in FIG. 1. Further, an operation unit 4 includes an operation panel (not shown) being an input unit for input of data and a display screen (not shown) being a display portion, and alarm information or the like (described later) is displayed on the display screen.

Figure 2:
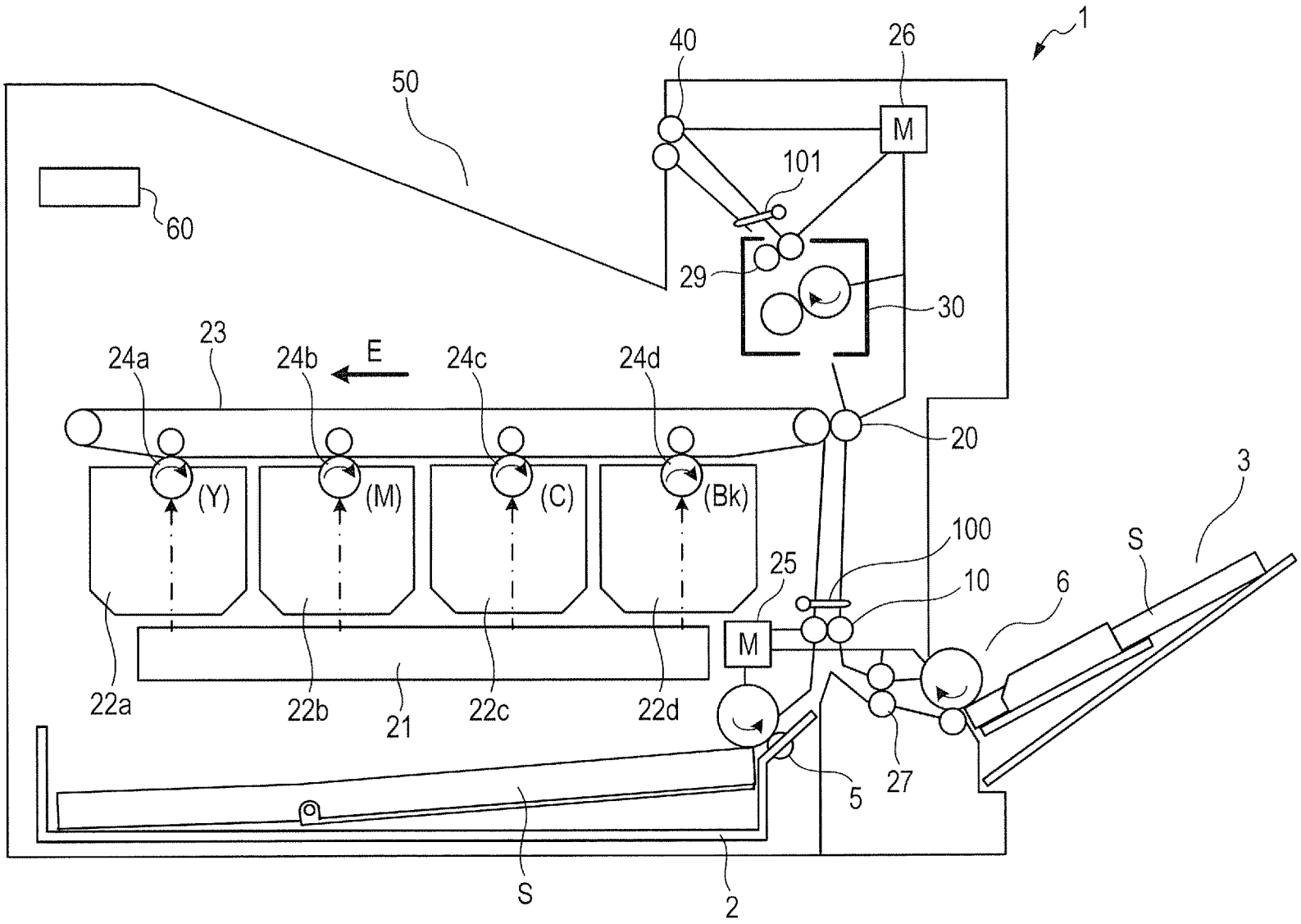
FIG. 2 is a sectional view for illustrating a configuration of the image forming apparatus according to the first embodiment and the second embodiment.

FIG. 2 is a sectional view for illustrating a configuration of the image forming apparatus 1 illustrated in FIG. 1. The image forming apparatus 1 illustrated in FIG. 2 is a color image forming apparatus which is configured to form a color image by an electrophotographic image forming process using developer (toner) of four colors including yellow (Y), magenta (M), cyan (C), and black (Bk). In FIG. 2, process cartridges 22*a*, 22*b*, 22*c*, and 22*d* include toner containers (not shown) storing toners of respective colors including yellow, magenta, cyan, and black, and photosensitive drums 24 (24*a* to 24*d*) on which toner images are to be formed. The suffixes a, b, c, and d of the reference symbols indicate components corresponding to yellow (Y), magenta (M), cyan (C), and black (Bk). In the following description, the suffixes of the reference symbols are omitted unless a specific process cartridge or photosensitive drum is described. Further, a controller 60 being a control unit performs control of an entire image forming apparatus including an image forming operation of the image forming apparatus 1 (described later).

When a user inputs a print instruction through the operation unit 4 (FIG. 1), the image forming apparatus 1 starts the image forming operation. When the image formation is started, an exposure device 21 turns on and off laser light (one-dot chain line arrows in FIG. 2) in accordance with image signals of respective colors including yellow (Y), magenta (M), cyan (C), and black (Bk) to scan surfaces of corresponding photosensitive drums 24*a* to 24*d*. With this action, electrostatic latent images are formed on the photosensitive drums 24 being rotated in the arrow direction (clockwise direction). A developing roller (not shown) causes toner to adhere to the electrostatic latent images having been formed so that toner images are formed on the respective photosensitive drums 24. After that, the toner images formed on the photosensitive drums 24 are superimposed and transferred onto an intermediate transfer belt 23 moving in the arrow E direction, thereby forming a color image on the intermediate transfer belt 23.

The image forming apparatus 1 feeds a sheet S from the sheet feeding tray of the sheet feeding cassette 2 or the manual feeding tray 3 in accordance with an instruction from a user. The sheet S fed from the sheet feeding cassette is conveyed to a registration roller pair 10 by a conveyance roller which rotates in the arrow direction in the sheet feeding portion 5. Meanwhile, the sheet S fed from the manual feeding tray 3 is conveyed to the registration roller pair 10 by a conveyance roller which rotates in the arrow direction and an intermediate conveyance roller pair 27 in the sheet feeding portion 6. At a timing at which the top sensor 100 detects the sheet S having passed through the registration roller pair 10, the image forming apparatus 1 calculates a time difference with respect to a timing at which the toner images having been transferred onto the intermediate transfer belt 23 arrive at the transfer roller 20. Then, based on the time difference having been calculated, the image forming apparatus 1 controls conveyance of the sheet S so that the toner images on the intermediate transfer belt 23 and the sheet S arrive at the transfer roller 20 at the same timing. Then, the toner images on the intermediate transfer belt 23 are transferred to the sheet S having arrived at the transfer roller 20. The exposure device 21, the process cartridges 22, the intermediate transfer belt 23, and the transfer roller 20, which are mentioned above, construct an image forming portion configured to perform image formation on the sheet S. The configuration of the top sensor 100 and the mechanism of detecting the sheet S are described above, and hence description thereof is now omitted.

The sheet S having the toner images transferred thereon is heated and pressurized in a fixing unit 30, and the toner images on the sheet S are fixed to the sheet S. The sheet S having the toner images fixed thereto passes through a fixing outlet roller 29 and a fixing outlet sensor 101 and is conveyed to the discharge roller 40. The discharge roller 40 discharges the sheet S onto a discharge tray 50 provided in an upper portion of the image forming apparatus 1 under a state in which a surface having the toner images transferred thereto (surface subjected to image formation) faces downward. The fixing outlet sensor 101 being a second detection unit has the same configuration as the top sensor 100, and is configured to detect the sheet S being conveyed.

Further, the image forming apparatus 1 includes motors 25 and 26 which are drive sources configured to drive conveyance rollers provided on the conveyance path through which the sheet S is conveyed. The motor 25 being a first drive unit drives the following conveyance rollers being a first conveyance unit provided on the conveyance path extending from the sheet feeding cassette 2 and the manual feeding tray 3 to the registration roller pair 10. That is, the motor 25 drives the conveyance roller of the sheet feeding portion 5, the conveyance roller of the sheet feeding portion 6, the intermediate conveyance roller pair 27, and the registration roller pair 10. The sheet S is fed from either one of the sheet feeding cassette 2 and the manual feeding tray 3. Therefore, clutch mechanisms (not shown) configured to transmit and cut the drive of the motor 25 are provided between the motor 25 and the conveyance roller of the sheet feeding portion 5, between the motor 25 and the conveyance roller of the sheet feeding portion 6, and between the motor 25 and the intermediate conveyance roller pair 27, respectively. Further, the motor 26 being a second drive unit drives the following conveyance rollers being a second conveyance unit provided downstream in the conveyance path with respect to the registration roller pair 10. That is, the motor 26 drives the transfer roller 20, the pressurizing roller which rotates in the arrow direction of the fixing unit 30, the fixing outlet roller 29, and the discharge roller 40. Herein, the motors 25 and 26 are each configured to drive a plurality of conveyance rollers. In the first embodiment, it is only necessary that the conveyance rollers including the registration roller pair 10 disposed upstream in the conveyance path and the conveyance rollers disposed downstream in the conveyance path with respect to the registration roller pair 10 are not driven by the same motor. Thus, the conveyance rollers may be driven by different motors, respectively.

[Detection of Sheet Length when Sheet-to-Sheet Distance is Long]

Next, detection of the sheet length of the actual sheet S being fed in the conveyance path is described. Now, with reference to FIG. 3, description is made of a method of calculating the sheet length of the preceding sheet S1 in the case in which the sheet-to-sheet distance between two sheets is so long that the trailing edge of the preceding sheet S1 and the leading edge of the following sheet S2 can be detected by the top sensor 100 as illustrated in FIG. 7A referred to above.

Figure 3:
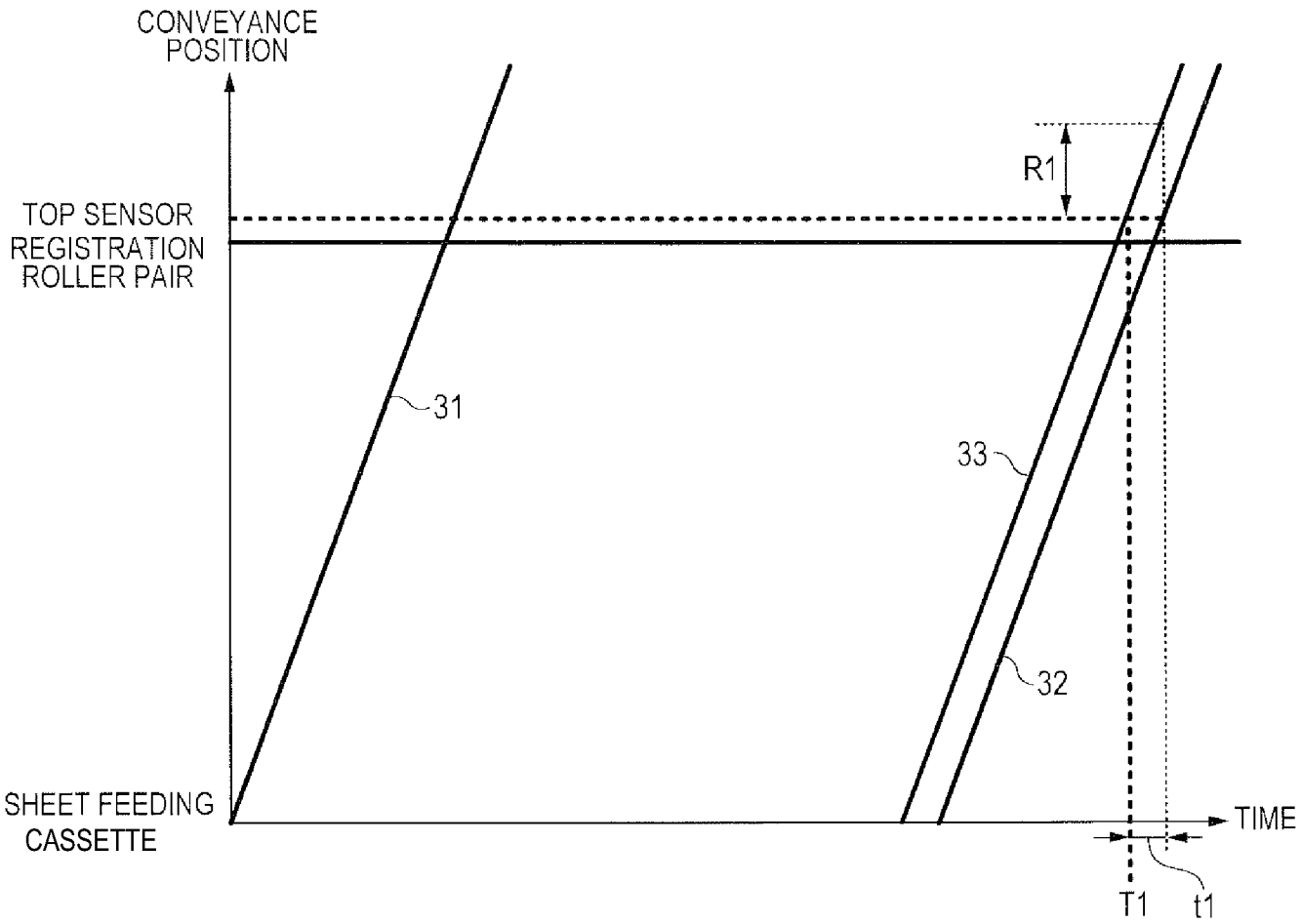
FIG. 3 is a timing chart for illustrating behaviors of a leading edge and a trailing edge of a sheet in the first embodiment and the second embodiment.

FIG. 3 is an image view of a conveyance control diagram for illustrating behaviors of the leading edge and the trailing edge of the preceding sheet S1. In FIG. 3, the horizontal axis represents time, and the vertical axis represents positions on the conveyance path on which the preceding sheet S1 is to be conveyed using members provided on the conveyance path (sheet feeding cassette 2, registration roller pair 10, and top sensor 100). In FIG. 3, the preceding sheet S1 is fed from the sheet feeding cassette 2. However, the preceding sheet S1 may be fed from the manual feeding tray 3. This similarly applies to FIG. 4A and FIG. 4B (described later). In FIG. 3, the locus 31 represents a state in which the leading edge of the actual preceding sheet S1 is conveyed in the conveyance path from the sheet feeding cassette 2 to the top sensor 100. Further, the locus 32 represents a state in which the trailing edge of the actual preceding sheet S1 is conveyed in the conveyance path from the sheet feeding cassette 2 to the top sensor 100. Similarly, the locus 33 represents a state in which the trailing edge of the preceding sheet S1 is conveyed on the conveyance path in a case in which the preceding sheet S1 has a preset sheet length L1. Further, time T1 (also referred to as "timing T1") represents a timing at which, after the leading edge of the preceding sheet S1 passes through the top sensor 100, the trailing edge of the preceding sheet S1 in the case of having the sheet length L1 passes through the top sensor 100. Further, a time period t1 represents a time difference between the time T1 and a time at which a trailing edge of an actual preceding sheet S1 having a sheet length longer than the preset sheet length L1 passes through the top sensor 100. In FIG. 3, the conveyance speed of the preceding sheet S1 is equal to the conveyance speed of the sheet S conveyed by the transfer roller 20 described with reference to FIG. 2. The distance R1 in FIG. 3 represents a difference between the sheet length of the actual preceding sheet S1 and the preset sheet length L1, and is a distance which can be calculated by multiplying the conveyance speed of the preceding sheet S1 by the time period t1.

From FIG. 3, when the actual sheet length of the preceding sheet S1 is represented by L(S1), the actual sheet length L(S1) can be calculated by following Expression (1).

$$L(S1)\ [\text{mm}]=L1\ [\text{mm}]+V\ [\text{mm/sec}]\times t1\ [\text{sec}]=L1\ [\text{mm}]+R1\ [\text{mm}] \quad (1)$$

L1 represents a sheet length of the preceding sheet S1 which is preset to the image forming apparatus, and V is a conveyance speed (unit: ram/sec) of the preceding sheet S1. Further, the time period t1 is elapsed time (unit: sec), with the timing T1 at which it is estimated that the trailing edge (locus 33) of the preceding sheet S1 having the sheet length L1 passes through the top sensor 100 as a reference, to a timing at which the trailing edge (locus 32) of the preceding sheet S1 actually passes through the top sensor 100.

[Jam Detection of Preceding Sheet and Following Sheet]

Figure 4A:
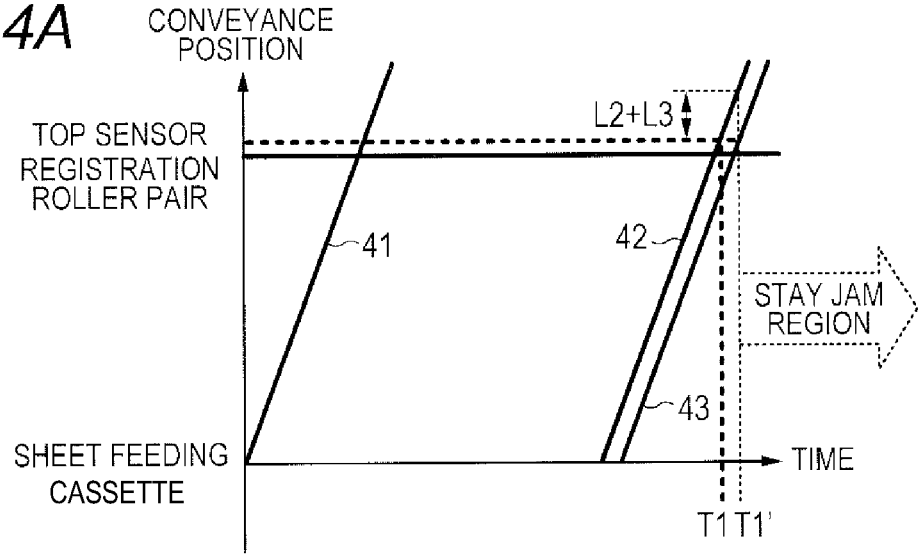
FIG. 4A, FIG. 4B, and FIG. 4C are timing charts for illustrating behaviors of the preceding sheet and the following sheet in the first embodiment and the second embodiment.
Figure 4B:
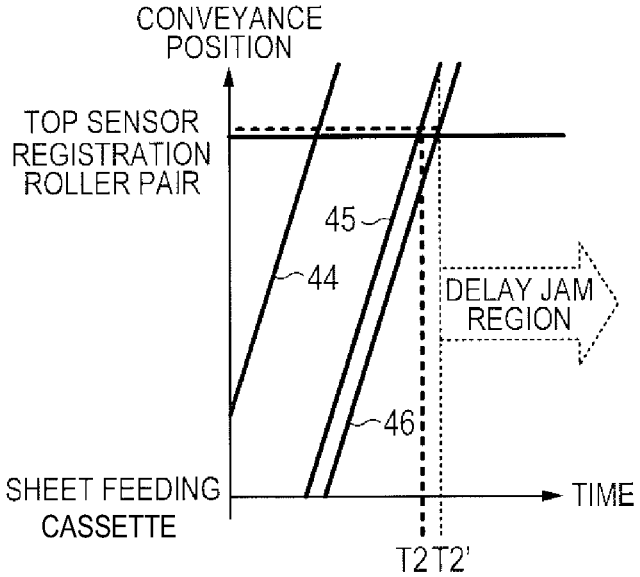
Figure 4C:
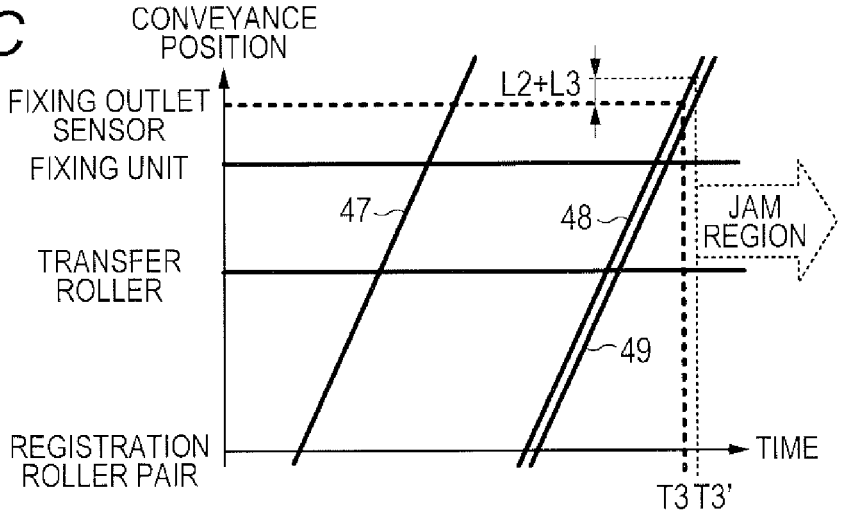

Next, jam detection of the preceding sheet S1 and the following sheet S2 at the top sensor 100 is described with reference to FIG. 4A to FIG. 4C. FIG. 4A to FIG. 4C are image views of conveyance control diagrams for illustrating behaviors of the leading edge and the trailing edge of the preceding sheet S1 and the leading edge of the following sheet S2 when the preceding sheet S1 and the following sheet S2 are conveyed at the conveyance speed equal to that of the transfer roller 20. In the following description, L1 is a preset sheet length of the preceding sheet S1. L2 is a margin length of the preceding sheet S1 which does not lead to determination that the sheet length irregularity is present, and has a maximum length of the region L2 in FIG. 7A referred to above. L3 represents a length of the preceding sheet S1 which leads to the determination that the sheet length irregularity is present, and has a maximum length of the region L3 in FIG. 7A referred to above.

FIG. 4A is an image view of a conveyance control diagram for illustrating behaviors of the leading edge and the trailing edge of the preceding sheet S1. In FIG. 4A, the horizontal axis represents time, and the vertical axis represents positions on the conveyance path on which the preceding sheet S1 is to be conveyed using members provided on the conveyance path (sheet feeding cassette 2, registration roller pair 10, and top sensor 100). In FIG. 4A, the locus 41 represents a state in which the leading edge of the preceding sheet S1 is conveyed on the conveyance path from the sheet feeding cassette 2 to the top sensor 100. Further, the locus 42 represents a state in which the trailing edge of the preceding sheet S1 is conveyed on the conveyance path in the case in which the preceding sheet S1 has the preset sheet length L1. The locus 43 represents a state in which the trailing edge of the preceding sheet S1 having a sheet length of (L1+L2+L3) is conveyed on the conveyance path from the sheet feeding cassette 2 to the top sensor 100. Similarly to FIG. 3, the time T1 represents a theoretical timing (timing which can be obtained by calculation) which is an estimated timing at which the trailing edge of the preceding sheet S1 having the sheet length L1 passes through the top sensor 100. Further, a time T1' being a first timing (also referred to as "timing T1'") represents a timing at which the trailing edge of the preceding sheet S1 having the sheet length of (L1+L2+L3) passes through the top sensor 100. As mentioned above, when the sheet length of the preceding sheet S1 is larger than (L1+L2) and equal to or less than (L1+L2+L3), the image forming apparatus 1 determines that the sheet length irregularity of the preceding sheet S1 is present. Meanwhile, when the sheet length of the preceding sheet S1 is larger than (L1+L2+L3), the locus of the trailing edge of the preceding sheet S1 is shifted to the stay jam region side on the right side in FIG. 4A with respect to the locus 43, with the result that it is determined that the stay jam involving stay at the top sensor 100 has occurred.

FIG. 4B is an image view of a conveyance control diagram for illustrating behaviors of the trailing edge of the preceding sheet S1 and the leading edge of the following sheet S2. In FIG. 4B, the horizontal axis represents time, and the vertical axis represents positions on the conveyance path on which the preceding sheet S1 and the following sheet S2 are to be conveyed using members provided on the conveyance path (sheet feeding cassette 2, registration roller pair 10, and top sensor 100). In FIG. 4B, the locus represents a state in which the trailing edge of the preceding sheet S1 is conveyed on the conveyance path from the sheet feeding cassette 2 to the top sensor 100. Further, the locus 45 represents a state in which the leading edge of the following sheet S2 being conveyed with a predetermined sheet-to-sheet distance with the preceding sheet S1 is conveyed on the conveyance path. The following sheet S2 is fed in a cycle of time (timing) calculated by dividing a distance, which is obtained by adding the margin length L2 not determined as the sheet length irregularity and the predetermined sheet-to-sheet distance to the preset sheet length of the preceding sheet S1, by the conveyance speed of the transfer roller 20. The locus 46 represents a state in which the leading edge of the following sheet S2 having a sheet-to-sheet distance, which corresponds to the delay amount causing the following sheet S2 to be determined as the delay jam, with the trailing edge of the preceding sheet S1 is conveyed on the conveyance path.

The time T2 (also referred to as "timing T2") represents a theoretical timing being an estimated timing at which the leading edge of the following sheet S2 passes through the top sensor 100. In the first embodiment, the following sheet S2 is fed, after feeding of the preceding sheet S1, based on the preset sheet length L1, the margin length L2 of the sheet length, and the predetermined sheet-to-sheet distance. Further, the time T2' (also referred to as "timing T2'") represents a timing at which the leading edge of the following sheet S2 passes through the top sensor 100 when a delay that is determined as the delay jam occurs. When the delay amount of the following sheet S2 is less than a threshold value, the normal print action is continued. Meanwhile, when the delay amount is equal to or more than the threshold value, the locus of the leading edge of the following sheet S2 is shifted to the delay jam region side on the right side in FIG. 4B with respect to the locus 46, with the result that it is determined that the delay jam involving delay in arrival at the top sensor 100 has occurred.

As mentioned above, the image forming apparatus 1 includes the fixing outlet sensor 101 configured to detect the sheet S. The fixing outlet sensor 101 is provided downstream in the conveyance path of the sheet S with respect to the fixing unit 30, and has the same configuration as the top sensor 100. FIG. 4C is an image view of a conveyance control diagram for illustrating behaviors of the leading edge and the trailing edge of the preceding sheet S1 to be detected by the top sensor 100 illustrated in FIG. 4A, and is applied to the fixing outlet sensor 101. In FIG. 4C, the horizontal axis represents time, and the vertical axis represents positions on the conveyance path on which the preceding sheet S1 is to be conveyed using members provided on the conveyance path (registration roller pair 10, transfer roller 20, fixing unit 30, and fixing outlet sensor 101). In FIG. 4C, the locus 47 represents a state in which the leading edge of the preceding sheet S1 is conveyed on the conveyance path from the registration roller pair 10 to the fixing outlet sensor 101. Further, the locus 48 represents a state in which the trailing edge of the preceding sheet S1 is conveyed on the conveyance path when the preceding sheet S1 has the preset sheet length L1. The locus 49 represents a state in which the trailing edge of the preceding sheet S1 having the sheet length of (L1+L2+L3) is conveyed on the conveyance path from the registration roller pair 10 to the fixing outlet sensor 101.

The time T3 (also referred to as "timing T3") represents a theoretical timing (timing which can be obtained by calculation) which is an estimated timing at which the trailing edge of the preceding sheet S1 having the sheet length L1 passes through the fixing outlet sensor 101. Further, the time T3' (also referred to as "timing T3'") being a second timing represents a timing at which the trailing edge of the preceding sheet S1 having the sheet length of (L1+L2+L3) passes through the fixing outlet sensor 101. Also at the fixing outlet sensor 101, similarly to the top sensor 100, when the sheet length of the preceding sheet S1 is larger than (L1+L2) and equal to or smaller than (L1+L2+L3), the image forming apparatus 1 determines that the sheet length irregularity of the preceding sheet S1 is present. Meanwhile, when the sheet length of the preceding sheet S1 is larger than (L1+L2+L3), the locus of the trailing edge of the preceding sheet S1 is shifted to the jam region side on the right side in FIG. 4C with respect to the locus 49, and it is determined that the jam has occurred.

[Control Sequence of Jam Detection]

Figure 5:
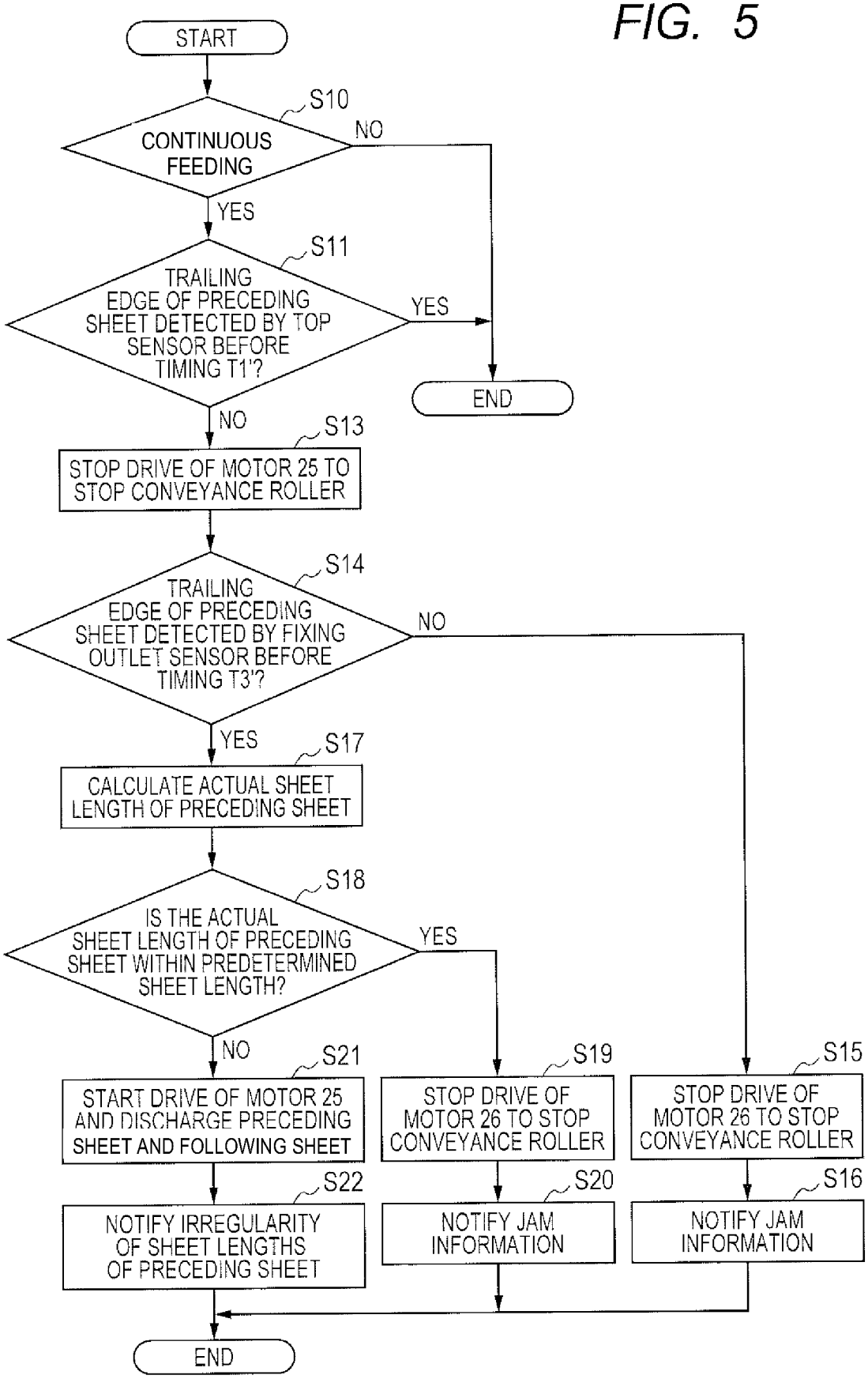
FIG. 5 is a flowchart for illustrating a control sequence for detection of a sheet length irregularity in the first embodiment and the second embodiment.

FIG. 5 is a flowchart for illustrating a control sequence executed in a case in which the jam of the sheet S is detected during image formation. The processing illustrated in FIG. 5 is activated when a user inputs a print instruction to the image forming apparatus 1 so that the image forming operation is performed. The processing is executed by the controller 60. FIG. 5 is an illustration of the processing to be executed when the jam is detected, and the image forming processing to be performed by the image forming apparatus 1 is not illustrated. The image forming operation is being performed at the time when the processing of FIG. 5 is activated. Therefore, conveyance rollers are driven by the motors 25 and 26 for conveyance of the sheet S.

In Step S10, the controller 60 determines whether or not the printing instructed by a user involves continuous feeding for image formation on two or more sheets S. When the controller 60 determines that the print instruction does not involve continuous feeding, the processing is terminated. When the controller 60 determines that the print instruction involves continuous feeding, the processing proceeds to Step S11.

In Step S11, the controller 60 determines whether or not the trailing edge of the preceding sheet S1 has been detected by the top sensor 100 before the timing T1' being the above-mentioned detection timing of the jam caused by stay of the trailing edge of the preceding sheet S1. When the controller 60 determines that the trailing edge of the preceding sheet S1 has been detected by the top sensor 100 before the timing T1', the processing is terminated. When the controller 60 determines that the trailing edge of the preceding sheet S1 has not been detected, the processing proceeds to Step S13.

The order of the timing T1' and the timing T2' of detecting the jam at the top sensor 100 may be set depending on the conveyance control specification of the image forming apparatus 1. The flowchart of FIG. 5 in the first embodiment is a flowchart in a case in which the timing T1' is earlier than the timing T2'. In a case in which the timing T2' is earlier than the timing T1', the following processing may be performed in place of Step S11. When the top sensor 100 does not detect the trailing edge of the preceding sheet S1 and does not detect the leading edge of the following sheet S2 before the timing T2' of determining the delay jam of the following sheet S2, the controller 60 allows the processing to proceed to Step S13. When the top sensor 100 detects the trailing edge of the preceding sheet S1 and does not detect the leading edge of the following sheet S2 before the timing T2', the controller 60 determines that the delay jam of the following sheet S2 has occurred, and shifts to the normal jam handling sequence.

In Step S13, in order to stop the conveyance of the preceding sheet S1 or the following sheet S2, the controller 60 stops drive of the motor 25 to stop the registration roller pair 10 and conveyance rollers which are provided upstream in the conveyance path with respect to the registration roller pair 10. At this time, when the trailing edge of the preceding sheet S1 passes through the registration roller pair 10, the preceding sheet S1 is conveyed on the conveyance path as it is by the conveyance rollers that are provided downstream in the conveyance path with respect to the registration roller pair 10 and driven by the motor 26.

In Step S14, the controller 60 determines whether or not the fixing outlet sensor 101 has detected the trailing edge of the preceding sheet S1 before the timing T3' being the above-mentioned detection timing for the jam caused by stay of the trailing edge of the preceding sheet S1. When it is determined that the fixing outlet sensor 101 has detected the trailing edge of the preceding sheet S1 before the timing T3', the controller 60 allows the processing to proceed to Step S17. When the fixing outlet sensor 101 has not detected the trailing edge of the preceding sheet S1 before the timing T3', the controller 60 allows the processing to proceed to Step S15. In Step S15, the controller 60 determines that preceding sheet S1 stays at the top sensor 100 or downstream in the conveyance path with respect to the top sensor 100, and stops drive of the motor 26. With this action, in addition to the above-mentioned processing in Step S13, the conveyance rollers provided downstream in the conveyance path with respect to the registration roller pair 10 are also stopped, thereby stopping all of the conveyance rollers on the conveyance path. In Step S16, the controller 60 displays jam information on a display screen of the operation unit 4 to notify a user of the occurrence of the jam, and terminates the processing.

Figure 6:
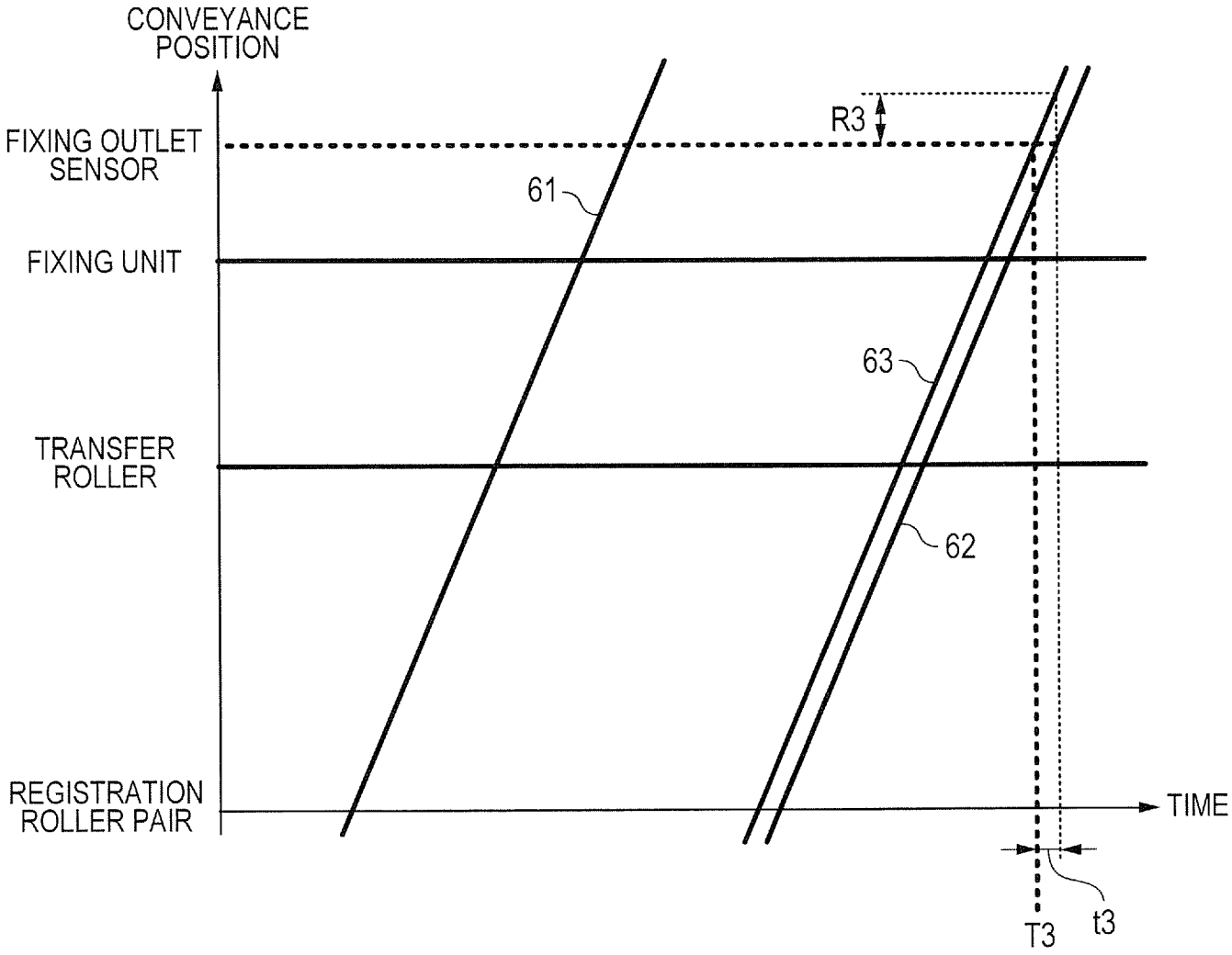
FIG. 6 is a timing chart for illustrating a behavior of the leading edge and the trailing edge of the sheet in the first embodiment and the second embodiment.

In Step S17, the controller 60 calculates an actual sheet length of the preceding sheet S1 based on the timings at which the fixing outlet sensor 101 has detected the leading edge and the trailing edge of the preceding sheet S1. Now, description is made of a method of calculating the actual sheet length of the preceding sheet S1 based on the detection result of the preceding sheet S1 by the fixing outlet sensor 101. FIG. 6 is an image view of the conveyance control diagram for illustrating the behavior of the leading edge and the trailing edge of the preceding sheet S1 detected by the fixing outlet sensor 101. In FIG. 6, the horizontal axis represents time, and the vertical axis represents positions on the conveyance path on which the preceding sheet S1 is to be conveyed using members provided on the conveyance path (registration roller pair 10, transfer roller 20, fixing unit 30, and fixing outlet sensor 101).

In FIG. 6, the locus 61 represents a state in which the leading edge of the preceding sheet S1 is conveyed on the conveyance path from the registration roller pair 10 to the fixing outlet sensor 101. Further, the locus 63 represents a state in which the trailing edge of the sheet S1 in the case in which the preceding sheet S1 has the preset sheet length L1 is conveyed on the conveyance path. The locus 62 represents a state in which the trailing edge of the actual preceding sheet S1 is conveyed on the conveyance path from the registration roller pair 10 to the fixing outlet sensor 101, and is a locus in the case in which the sheet length of the actual preceding sheet S1 is larger than the preset sheet length L1.

Further, the time T3 (also referred to as "timing T3") represents a timing at which the trailing edge of the preceding sheet S1 passes through the fixing outlet sensor 101 when the sheet length of the preceding sheet S1 is L1. The time T3 is a theoretical timing, and the controller 60 can determine the time T3, for example, by the following method. The controller 60 adds, to the time at which the fixing outlet sensor 101 detects the leading edge of the preceding sheet S1, the time obtained by dividing the length L1 of the preceding sheet S1 by the conveyance speed of the transfer roller 20. In such a manner, the controller 60 can calculate the above-mentioned time T3.

Further, the time period t3 represents a time difference between the time T3 and the time at which the trailing edge of the actual preceding sheet S1 passes through the fixing outlet sensor 101. In FIG. 6, the conveyance speed of the preceding sheet S1 is equal to the conveyance speed V of the sheet S conveyed by the transfer roller 20 described with reference to FIG. 3. The distance R3 in FIG. 6 is a distance calculated by multiplying the conveyance speed V of the preceding sheet S1 by the time period t3, and represents a difference between the actual sheet length of the preceding sheet S1 and the preset sheet length L1. From FIG. 6, when the actual sheet length of the preceding sheet S1 is L(S1), the actual sheet length L(S1) can be calculated by Expression (2) described below.

$$L(S1)\ [\text{mm}]=L1\ [\text{mm}]+V\ [\text{mm/sec}]\times t3\ [\text{sec}]=L1\ [\text{mm}]+R3\ [\text{mm}] \qquad \text{Expression (2)}$$

In Step S18, the controller 60 determines whether or not the actual sheet length L(S1) of the preceding sheet S1 calculated in Step S17 is within a predetermined length being equal to or smaller than the length (L1+L2) obtained by adding the margin length L2 to the preset sheet length L1 (or within a range of the predetermined sheet length). When the controller 60 determines that the actual sheet length L(S1) is equal to or smaller than (L1+L2), the controller 60 determines that the sheet interval could not be detected by the top sensor 100 because the following sheet S2 has reached the top sensor 100 too early, and allows the processing to proceed to Step S19. Meanwhile, when the controller 60 determines that the actual sheet length L(S1) is larger than the length (L1+L2), the controller 60 determines that the sheet interval could not be detected by the top sensor 100 because the actual sheet length of the preceding sheet S1 is excessively large (sheet length irregularity), and allows the processing to proceed to Step S21.

In Step S19, in order to stop conveyance of the preceding sheet S1, the controller 60 stops drive of the motor 26 to stop the conveyance rollers provided downstream in the conveyance path with respect to the registration roller pair 10. With this action, the drive of the motors 25 and 26 is stopped, thereby stopping all of the conveyance rollers on the conveyance path. In Step S20, the controller 60 displays jam information on the display screen of the operation unit 4 to notify a user of the occurrence of the jam, and terminates the processing.

In Step S21, the controller 60 determines that the sheet length of the preceding sheet S1 is irregular with respect to the preset sheet length but no jam has occurred. Then, the controller 60 drives again (re-drives) the motor 25 and discharges the following sheet S2 to the discharge tray 50. In Step S22, the controller 60 displays sheet length irregularity information on the display screen of the operation unit 4 to notify a user, and terminates the processing.

As mentioned above, when the sheet-to-sheet distance becomes smaller due to a large actual sheet length, and thus the top sensor 100 cannot detect the sheet interval, only the conveyance of the following sheet S2 is stopped, and the sheet interval is increased. With this action, the actual sheet length of the preceding sheet S1 can be detected at the fixing outlet sensor 101. As a result, even when the sheet interval cannot be detected by the top sensor 100 due to the actual sheet length which is excessively larger than the preset sheet length, the image forming apparatus can discharge the preceding sheet S1 and the following sheet S2 to an outside of the image forming apparatus. With this action, in the case of the sheet length irregularity, a user is not required to perform jam handling of the sheet staying in the image forming apparatus, thereby being capable of improving the usability.

As described above, according to the first embodiment of the present invention, regardless of the magnitude of the sheet interval, when the actual sheet length is larger than the set sheet length, the sheets being conveyed can be discharged to the outside of the image forming apparatus without handling by a user.

Second Embodiment

In the first embodiment, the actual sheet length is calculated based on elapsed time from detection of the leading edge of the sheet to detection of the trailing edge of the sheet by the top sensor 100 or the fixing outlet sensor 101. In a second embodiment of the present invention, description is made of a method of calculating the sheet length based on the rotation number of the motor configured to drive the conveyance rollers for conveying the sheet S.

[Detection of Sheet Length]

In the second embodiment, a pulse motor (also referred to as "stepping motor") driven in accordance with pulse signals is used as the motor 25 configured to drive the conveyance rollers including the registration roller pair 10 disposed upstream in the conveyance path. The distance by which the preceding sheet S1 is conveyed per pulse signal by rotation of the motor 25 in accordance with the pulse signal is Ls. Further, with the above-mentioned timing T1 as a reference, the number of steps of the motor 25 until the top sensor 100 actually detects the trailing edge of the preceding sheet S1 (the number of pulse signals input to the motor 25) is S. The sheet length L(S1) of the preceding sheet S1 described with Expression (1) in the first embodiment can be calculated by Expression (3) described below with use of the conveyance distance Ls and the number of steps S of the motor 25.

$$L(S1)\ [\mathrm{mm}]=L1\ [\mathrm{mm}]+Ls\ [\mathrm{mm/step}]\times S[\mathrm{step}] \quad (3)$$

As mentioned above, in the second embodiment, through the use of the number of steps of the motor 25, the actual sheet length can be calculated regardless of the conveyance speed of the sheet S. In the above, description is made of the case in which the motor 25 is the pulse motor. However, it may also be applied to the case in which the motor 26 is the pulse motor. In the second embodiment, description is made of the example in which the pulse motor is used for the motor 25. However, for example, the actual sheet length can be calculated also by providing an encoder configured to measure the rotation number of the motor to the motors 25 and 26. For example, the distance by which the sheet S is conveyed per second can be calculated by measuring the rotation number of the motor 25 per second, and multiplying the measured rotation number by the distance by which the preceding sheet S1 is conveyed per rotation. Then, the calculated conveyance distance per unit time (1 second) is multiplied by the time difference between the time at which the trailing edge of the preceding sheet S1 having the preset sheet length passes through the top sensor 100 and the time at which the trailing edge of the actual preceding sheet S1 passes through the top sensor 100. A preset sheet length is added to the calculated difference between the preset sheet length and the actual sheet length, thereby being capable of calculating the actual sheet length of the sheet S.

As described above, according to the second embodiment, regardless of the magnitude of the sheet interval, when the actual sheet length is larger than the set sheet length, the sheets being conveyed can be discharged to an outside of the image forming apparatus without handling by a user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-084430, filed Apr. 21, 2017, which is hereby incorporated by reference herein in its entirety.

What is claimed is:

1. An image forming apparatus comprising:

a first conveyance unit configured to convey sheets along a conveyance path;

a second conveyance unit provided downstream of the first conveyance unit with respect to a conveyance direction of the sheets and configured to convey the sheets;

a first detection unit configured to detect the sheets;

a second detection unit provided downstream of the first detection unit with respect to the conveyance direction, the second detection unit configured to detect the sheets; and a control unit configured to start drive of the first conveyance unit and the second conveyance unit in a case where a first sheet and a second sheet subsequent to the first sheet are conveyed along the conveyance path, and configured to stop the drive of the first conveyance unit and continue the drive of the second conveyance unit in a case where the first detection unit does not detect a trailing edge of the first sheet before a predetermined timing, wherein the control unit is configured to re-drive the first conveyance unit in a case where a sheet length of the first sheet in the conveyance direction obtained by the second detection unit is longer than a predetermined length and configured to stop the drive of the second conveyance unit in a case where the sheet length of the first sheet is shorter than or equal to the predetermined length.

2. The image forming apparatus according to claim 1, wherein in a case where the second detection unit does not detect the trailing edge of the first sheet before a second predetermined timing later than the predetermined timing, the control unit is configured to stop the drive of the second conveyance unit to stop conveyance of the first sheet and the second sheet.

3. The image forming apparatus according to claim 2, further comprising a display unit configured to display information, wherein the control unit is configured to display alarm information indicating occurrence of a jam on the display unit.

4. The image forming apparatus according to claim 1, wherein in a case where the sheet length of the first sheet is longer than the predetermined length, the control unit re-drives the first conveyance unit to discharge the first sheet and the second sheet to an outside of the image forming apparatus.

5. The image forming apparatus according to claim 4, further comprising a display unit configured to display information, wherein the control unit is configured to display alarm information indicating sheet length irregularity on the display unit.

6. The image forming apparatus according to claim 1, wherein in a case where the sheet length of the first sheet is shorter than or equal to the predetermined length, the control unit is configured to stop the drive of the second conveyance unit to stop conveyance of the first sheet and the second sheet.

7. The image forming apparatus according to claim 6, further comprising a display unit configured to display information, wherein the control unit is configured to display alarm information indicating occurrence of a jam on the display unit.

8. The image forming apparatus according to claim 1, further comprising an input unit configured to input data, wherein the predetermined length is input by the input unit.

9. The image forming apparatus according to claim 1, further comprising a trailing edge regulation member configured to regulate a position of the trailing edge of the sheets stacked on a stacking unit with respect to the conveyance direction, wherein the predetermined length is determined in accordance with a position at which the trailing edge regulation member is set.

10. The image forming apparatus according to claim 1, wherein the second detection unit is provided downstream of a transfer portion configured to transfer an image on the sheets with respect to the conveyance direction.

11. The image forming apparatus according to claim 1, wherein the control unit is configured to calculate the sheet length of the first sheet based on a detection result of one of the first detection unit and the second detection unit.

12. The image forming apparatus according to claim 11, wherein the control unit is configured to calculate the sheet length of the first sheet based on time from detection of a leading edge of the first sheet by the first detection unit to detection of the trailing edge of the first sheet by the first detection unit and a conveyance speed at which the first sheet is conveyed, or based on time from detection of the leading edge of the first sheet by the second detection unit to detection of the trailing edge of the first sheet by the second detection unit and the conveyance speed at which the first sheet is conveyed.

13. The image forming apparatus according to claim 1, wherein the first detection unit and the second detection unit each include a lever to be moved by being brought into contact with a sheet, and are each configured to output a signal which is different in accordance with a position of the lever.

14. The image forming apparatus according to claim 1, wherein the first conveyance unit is provided upstream of the first detection unit with respect to the conveyance direction.

15. The image forming apparatus according to claim 1, wherein the second conveyance unit is provided downstream of the first detection unit with respect to the conveyance direction.

16. The image forming apparatus according to claim 1, wherein the second conveyance unit is provided upstream of the second detection unit with respect to the conveyance direction.

* * * * *